United States Patent [19]

Hayday

[11] Patent Number: 4,932,910

[45] Date of Patent: Jun. 12, 1990

[54] EMERGENCY LOCATION MARKER SYSTEM

[76] Inventor: Birgitt B. Hayday, 5 Timber Ridge Rd., Oyster Bay, N.Y. 11771

[21] Appl. No.: 273,849

[22] Filed: Nov. 21, 1988

[51] Int. Cl.[5] ..... B63B 45/00

[52] U.S. Cl. ..... 441/11; 441/6; 441/9; 441/12; 441/16

[58] Field of Search ..... 441/6–9, 441/11–13, 1, 16, 17, 20, 27, 32, 33; 114/266; 455/97; 343/709; 116/107, 2 C

[56] References Cited

U.S. PATENT DOCUMENTS

| | | | |
|---|---|---|---|
| 2,825,803 | 3/1958 | Newbrough | 441/11 |
| 3,132,322 | 5/1964 | Maes | 441/11 |
| 3,253,810 | 5/1966 | Penn | 441/11 |
| 3,590,406 | 7/1971 | Lockwood | 441/11 |
| 3,760,411 | 9/1973 | Handelman | 441/11 |
| 4,224,707 | 9/1980 | Mariani | 441/11 |
| 4,433,638 | 2/1984 | Ashline | 441/11 |

*Primary Examiner*—Joseph F. Peters, Jr.
*Assistant Examiner*—Clifford T. Bartz
*Attorney, Agent, or Firm*—Michael I. Kroll

[57] ABSTRACT

The emergency location marker system carried by a vessel for marking a location on the water and signaling, especially for locating and rescuing an individual in the water, comprises a flotation and support structure with an advantageously collapsible self-erecting tower, location-indicating devices at least one of which is mounted on the top portion of the tower, a mechanical deploying and actuating assembly for launching and activating the emergency location marker system and an electrical supply and control system. The location-indicating devices may include audio sounders, a strobe light and a self-erecting passive reflector for light and radar mounted at the top portion of the collapsible self-erecting tower below the strobe light, a low frequency transmitter and an electrical and retracting cable connected to the top portion of the collapsible self-erecting antenna tower.

12 Claims, 4 Drawing Sheets

EMERGENCY LOCATION MARKER SYSTEM

THE FIELD OF THE INVENTION

The instant invention relates to a marker system or signaling device for the location of an emergency condition on a body of water and, more particularly, to an emergency location marker system which assists in rescuing an individual in offshore and inshore waters.

THE BACKGROUND OF THE INVENTION

Emergency events at sea include man overboard situations which can occur on both sailboats, sailing and mechanically powered vessels. Other emergency conditions of interest include capsized vessels, vessels which have lost power, aircraft accidents which are in range of Coast Guard and other rescue vessels, astronaut recovery operations and of course sinking vessels. All operations designed to reduce personnel in these situations are complicated by the motion of an individual in the water due to ocean currents, wave motion and wind and by the relative motion of the vessel or aircraft from which the individual originates. Storms and fogs can make the problem of finding individuals lost at sea even more difficult. A time-consuming search with a large number of vessels and aircraft which covers a large area is often required.

Generally when personnel aboard a boat become aware that an individual has fallen overboard they perform any number of rescue-oriented actions from simply throwing a line or a life preserver to the individual to launching a smaller rescue craft, e.g. an inflatable life raft with some lift-sustaining emergency supplies. For an entire distressed vessel marker buoys may be deployed.

However on a medium-sized boat, e.g. from 20 to 40 ft, space for gear is often a problem so that one is often limited to using either a lift preserver or line to help rescue an individual who falls overboard. In the case of a sailboat the problem is further complicated by the fact that it is difficult to stop or reverse the direction 20 of motion which is controlled by the wind at least partially even when an auxiliary power system is on board. When heavy weather or fog is present an individual could be completely lost after falling overboard because of the forward momentum of the boat.

Many other problems are associated with existing rescue methods for an individual in the water. For example if provided with a light which can be used to attract a rescuer and if the light is easily visible to a dangerous fish, the individual can be lost in a very short time due to attack by the fish. In foggy or overcast environments a raft and rescue supplies might not be detected by the individual in the water without some attention-getting device on the raft. In heavy fog even an ordinary light might not be enough to signal the rescuing vessel. It is also desirable to provide redundant devices to provide backup.

It is an object of the instant invention to provide an improved emergency location marker system for an emergency event on water, especially for locating an individual who has fallen overboard.

It is also an object of the instant invention to provide an emergency location marker system for an emergency event on water which contains a number of redundant signaling devices useful for locating it in fog or heavy weather by both the individual in the water to be rescued and by the rescuing vessel or vessels.

It is another object of the instant invention to provide an emergency location marker system for locating and assisting an individual who has fallen overboard from a vessel on water, especially a sailboard, which has a number of redundant signaling devices useful for locating it by the individual in the water and by the rescuing vessel but which is extraordinarily compact when stowed on the vessel.

It is a further object of our invention to provide a compact emergency location marker system for an individual in the water which is easily detected by the individual in the water in all weather conditions and carries additional buoyancy, fresh water, flares and other survival-enhancing equipment.

It is an additional object of our invention to provide a compact emergency location marker system for an individual in the water which provides a means for supporting the individual in the water and which greatly shortens the time required to find the individual in the water by the rescue party.

SUMMARY OF THE INVENTION

According to our invention the emergency location marker system carried by a vessel comprises a flotation and support structure with an advantageously collapsible self-erecting tower, a location-indicating device or devices, a mechanical deploying and actuating assembly and an electrical supply and control system.

The location-indicating system may include any of a number of devices which generate a signal which the rescue party or the individual in the water can detect and follow to the emergency location marker system. Audio sounders which produce an audible signal may be installed so that an individual lost in the water can find the emergency location marker system even in a heavy fog. The emergency location marker system may be painted with day-glo paint to provide a high visibility. An easily detectable powerful strobe light may be installed to enhance visibility in darkness and fog. A low frequency transmitter using an electrical and retracting cable mounted and extended in the antenna and support tower may be incorporated to provide a low frequency radio signal. Alternatively a VHF transmitter may be provided. A rescue party with a hand-held DF or an installed DF or ADF or directional VHF antenna can home in on the low frequency or VHF frequency signal generated in this way. A collapsible self-erecting passive reflector for radar and light can be provided at or near the peak of the antenna tower with the strobe light assembly for visual detection. An EPIRB may be included to facilitate satellite tracking. Additional survival-enhancing equipment can be stowed in compartments or otherwise in the emergency location marker system. This equipment includes flares, fresh water, food and dye markers.

A drogue assembly attached to the ELMS(emergency location marking system) unit with a sea anchor and a conductive cable may also be included. Besides providing a sea ground for the LF transmitter the sea anchor helps to prevent drift from the initial location of the emergency.

When an arming pin and a D-ring of the ELMS are pulled or a solenoid is activated a launch mechanism disengages a lock pion from an actuating rod detent assembly in a water-tight compartment of the ELMS on which the collapsible self-erecting tower is mounted.

The actuating rod detent assembly has a rotational actuating bar which is spring-loaded by a torque-providing actuating spring which rotates when the lock pin is disengaged. The collapsible self-erecting tower is spring-loaded for extension and deployment but held in a collapsed configuration in stowage by an electrical and retraction cable wound around a spool with a ratchet gear engaged by a pawl rigidly attached to the rotational actuating bar and secured below the tower in the water-tight compartment. However the pawl is disengaged from the ratchet gear when the actuating spring rotates the rotational actuating bar so the self-erecting tower extends itself while being partially restrained by the unwinding of the cable from the spool. Also the rotating rotational actuating bar opens gas valves of twin gas cylinders mechanically releasing gas to gas-actuated lid openers which remove the top cover and the bottom cover from the ELMS device after a time delay so that the tower can be erected. Also some gas from the gas cylinders flows through a gas plenum in the water-tight compartment to a shroud covering the antenna and support tower inflating it. This assists in and provides backup for the erection of the tower.

A strobe light, audio sounders and the passive reflector for radar and light may be mounted at the top portion of the tower. Power for these devices can be provided by a rechargable battery pack through a series of switches allowing the individual in the water to shut off some of these devices when they are not necessary. The electrical and retraction cable transmits power to the strobe light and the audio sounders at the top of the tower and also may be an antenna for the LF transmitter.

A unique spring-loaded collapsible self-erecting passive reflector for radar and light may be provided at the peak of the collapsible self-erecting tower comprising a substantially planar horizontal element attached to the tower having four spring-loaded quadrants hingedly attached above and below it. These quadrants are folded flat against the horizontal element in the stowed configuration but spring open on deployment to form three reflective planar surfaces substantially at right angles to each other. Together with the shroud provided around the tower the passive reflector may provide secondary reflections from a strobe light mounted above it.

The emergency location marker system can be located by sight and sound in any weather condition by a person in the water who can then swim to it. Search vessels can locate it by radar, directional LF or optionally VHF receiver as well as audibly in fog or darkness. Searching requires only a fraction of the lengthy time used in current searches since a person in the water does not remain in any one geographic position but drifts due to wind, currents and wave movement. Backup is provided to insure a successful mission.

Further structural details and methods of operation are described in the detail description and claims appended below.

BRIEF DESCRIPTION OF THE DRAWING FIGURES

DETAILED DESCRIPTION OF THE INVENTION

Figure 1:
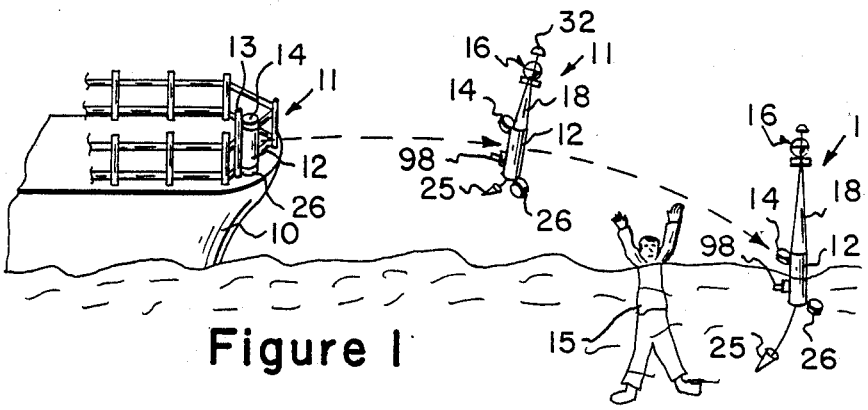
FIG. 1 is a perspective view showing the invention being launched and deployed from a vessel.
Figure 2:
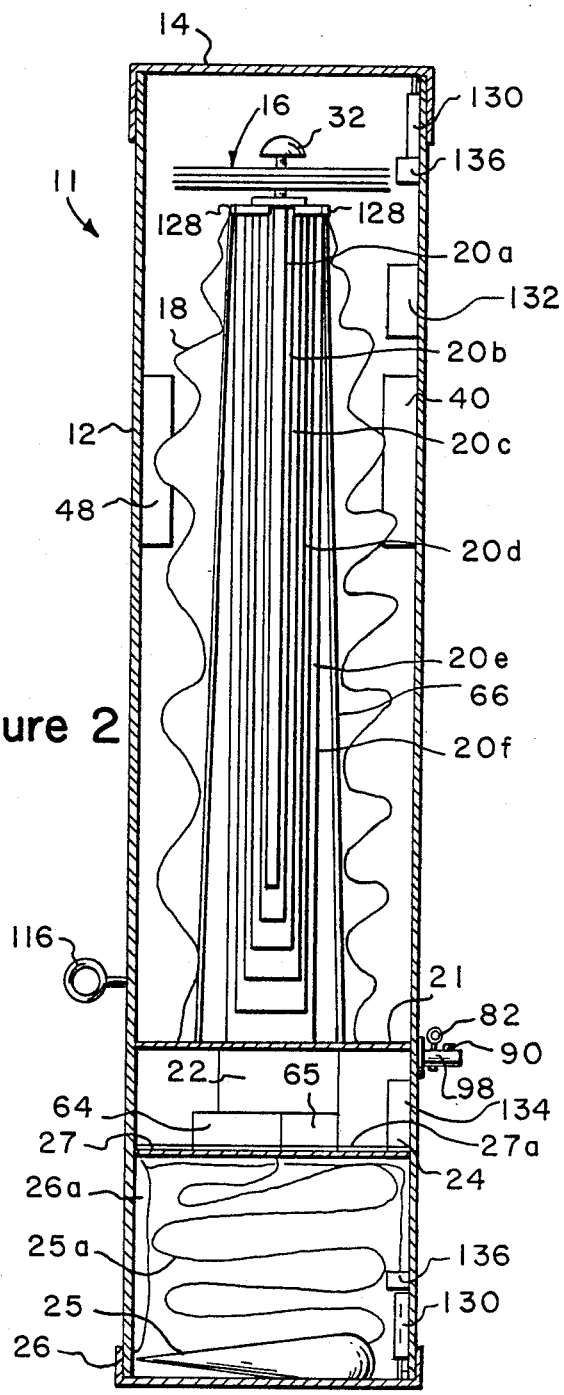
FIG. 2 is a longitudinal cross sectional view of the invention in a compact stowed and collapsed configuration.
Figure 3:
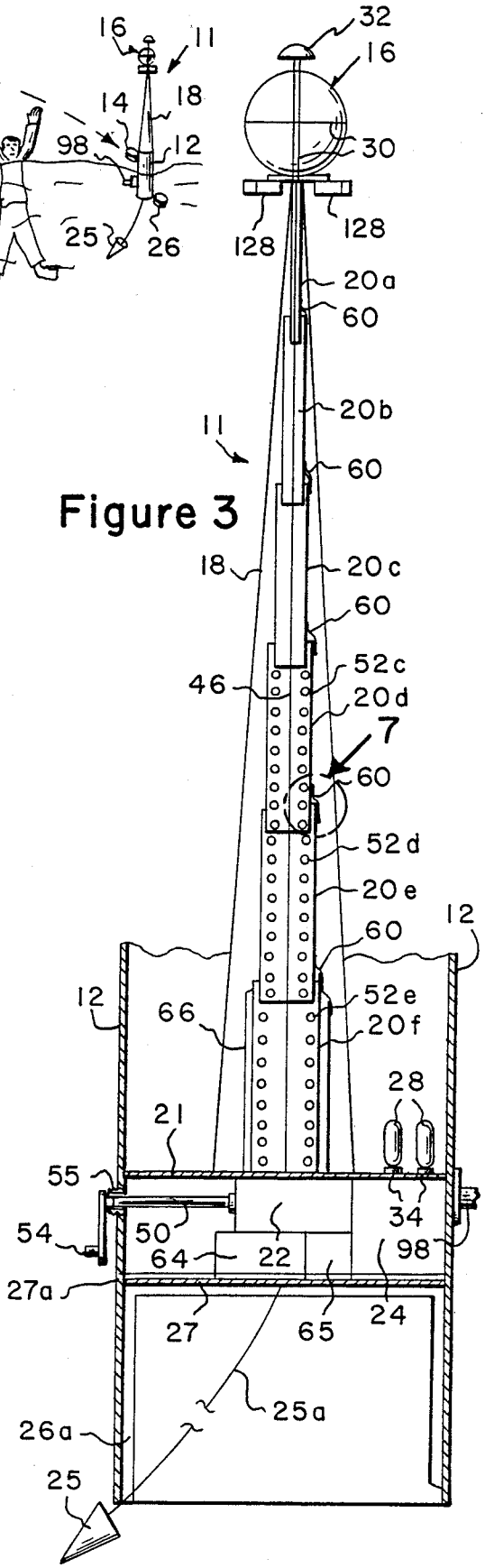
FIG. 3 is a longitudinal cross sectional view of the invention with parts broken away in a completely deployed configuration.

The emergency location marker system as seen particularly in FIGS. 1 to 3 comprises a flotation and support structure with a collapsible self-erecting tower 20*a*–20*f*, a location-indicating device or devices including a collapsible self-erecting passive reflector 16 for light and radar, a strobe light 32 above the passive reflector 16, a low frequency antenna 20 and LF transmitter 65 and audio sounders 128, a mechanical deploying and actuating assembly including an electromechanical release module 109 which remains attached to the vessel, gas cylinders 28 with an associated gas release mechanism and antenna mast extension springs 52*a*–*e* and an electrical supply and control system including a battery pack 64, a main power on/off switch 134 and control switches 132. It may also include a drogue assembly 25,25*a* including a sea anchor and LF ground system.

FLOTATION AND SUPPORT STRUCTURE

FIG. 1 shows the emergency location marker system 11 being launched in the water near a man in the water 15 as well details of the flotation and support structure for the location-indicating devices, FIGS. 2 and 3 show the emergency location marker system 11 first in its collapsed configuration as stowed on the stern of the vessel 10 indicated in FIG. 1 and then in its deployed configuration in the water near the man in the water 15.

The support structure comprises a rigid outer casing 12, a top cover 14 which is spring-loaded and gasactuated, a bottom cover 6 which is also spring-loaded and gas-actuated, an upper water-tight plate 21 on which the telescoping antenna and support tower 20*a*–20*f* is mounted and a water-tight plate 27 which is positioned below the upper water-tight plate 21. The bottom cover 26 and the top cover 14 are hingedly connected to the rigid outer casing 12 which in this example is cylindrical. Thus when the support structure is launched from the bracket 13 on the stern of the vessel 10 on which it is mounted prior to use, both the bottom spring-loaded cover 26 and the top cover 14 are opened.

Buoyancy is provided by the water-tight space enclosed between the upper water-tight plate 21 and the lower water-tight plate 27 which extend substantially perpendicularly to the walls of the outer casing 12. Of course auxiliary buoyancy means including a buoyancy bag 26*a* may be provided and may be blown up as needed. A copper plate 27*a* is provided coextensive with the lower water-tight plate 27 and immediately above it which is useful as a counterpoise to either the VHF or the LF transmitter.

The drogue 25 is located in the outer casing 12 immediately above the bottom cover 26 when in the collapsed stowed position. When the emergency location marker system 11 is deployed in the water and the bottom cover 26 opens the drogue 25 sinks and provides additional vertical stability by its attachment by conductive cable 25*a* to the water-tight plate 27 and 27*a*.

MECHANICAL DEPLOYING AND ACTUATING ASSEMBLY

The mechanical deploying and actuating assembly which launches the ELMS and raises the telescoping antenna and support toward 20*a*–20*f* comprises an electromechanical release module 109 which remains attached to a bracket 13 or in its vicinity on the stern of the vessel 10 when the emergency location marker system 11 is deployed, a plurality of mechanical antenna-actuating springs 52*a*–52*e* located inside the telescoping antenna and support tower 20*a*–20*f*, a gas-tight shroud 18 attached at its bottom to the upper water-tight plate 21 and at its top to the top portion of the telescoping antenna support tower 20*a*–20*f* and a gas delivery and valve device including gas cylinders 28, mechanically controlled gas valves 34 and gas plenum 68.

Figure 4:
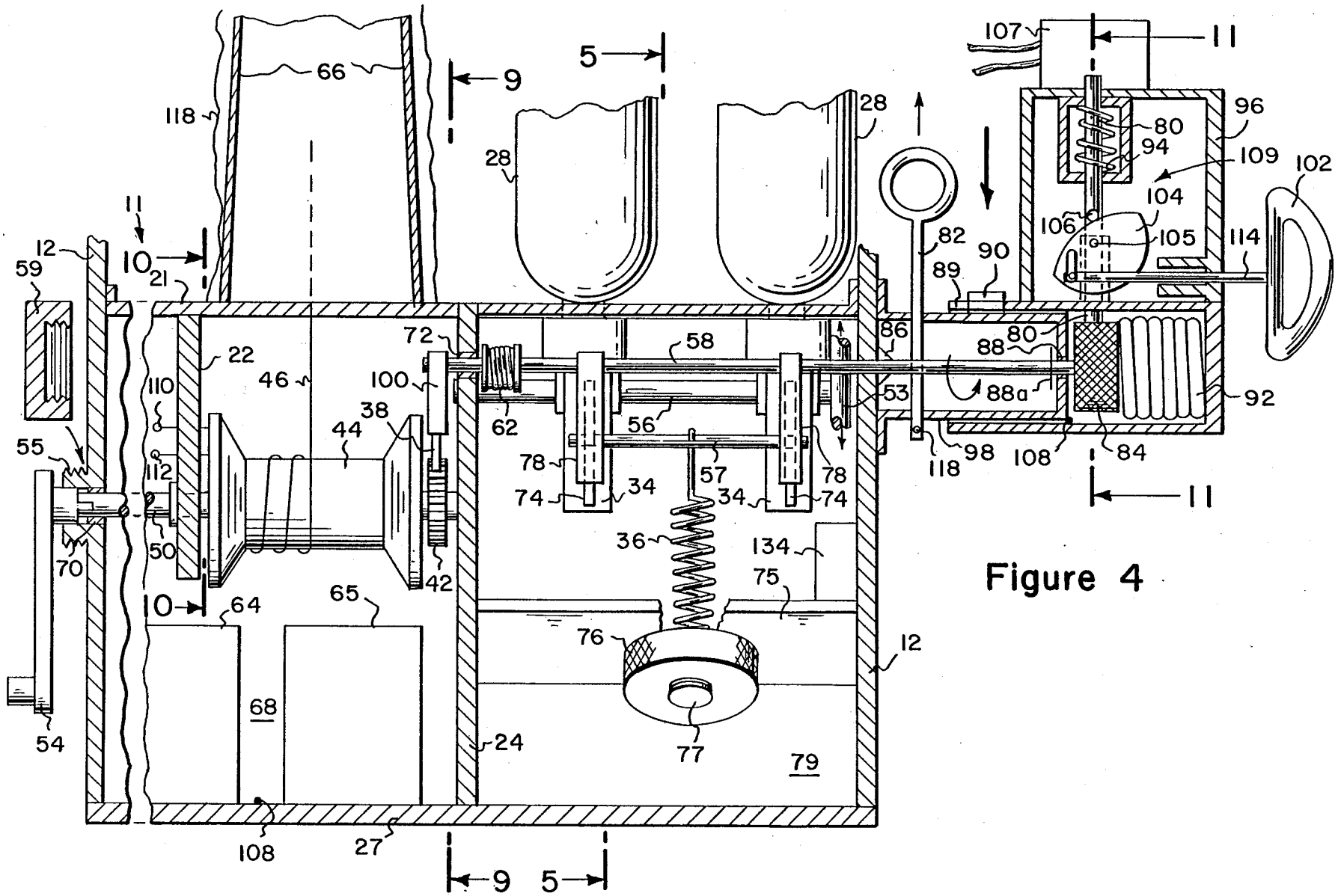
FIG. 4 is a detailed front cross sectional view with parts broken away showing the spool chamber, the valve chamber and the launch mechanism.
Figure 11:
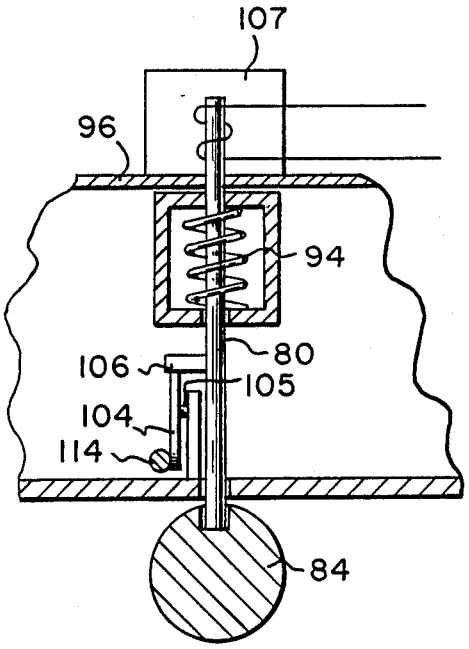
FIG. 11 is a cross sectional view taken along line 11—11 in FIG. 4 through the lock pin release mechanism in the launch mechanism showing the D-ring manual release and solenoid remote electrical release in greater detail.

FIGS. 2, 4 and 11 show the details of the electromechanical release module 109 which remains on the vessel 10 and the pipe-like actuating rod housing 98 which connects the outer casing 12 to the electromechanical release module 109 when mounted on the bracket 13. The electromechanical release module 198 comprises the launch mechanism housing 96, a lock pin 80 engaged in an actuating rod detent assembly and push plate 84 mounted in the pipe like actuating rod housing 98, an ejector compression spring 92 located in the launch mechanism housing 96 engaged on the actuating rod detent assembly and push plate 84 supported in the actuating rod housing 98 and a lock pin-cam assembly for releasing the lock pin 80 from the actuating rod detent assembly and push plate 84 so that the ejector compression spring 92 acts to force the push plate and the actuating rod housing 98 with the entire emergency location marker system 11 from the module 109.

The lock-pin cam assembly is shown specifically in FIG. 4. The lock pin 80 which is mounted substantially vertically in the launch mechanism housing 96 is spring-loaded by the lock pin compression spring 94 and has a substantially perpendicular comparatively short cam follower 106 attached. The cam follower 106 engages slidably a cam 104 pivotally mounted on a cam assembly axle 105 which is pivotally connected to a release shaft 114 having a D-ring 102 attached rigidly protruding on the vessel side of the electromechanical release module 198. When the D-ring is pulled withdrawing the release shaft 114 the lock pin 80 is forced upwardly by the eccentric shaped cam 104 disengaging it from the actuating rod detent assembly and push plate 84. A lock pin solenoid 107 may also be provided for remote release of the lock pin 80.

Figure 8:
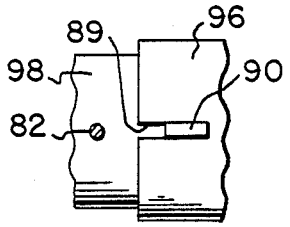
FIG. 8 is a top view with parts broken away taken in the direction of arrow 8 in FIG. 4 showing the locating key in greater detail.

The actuating rod housing 98 is also provided with a locating key 90. It comprises a substantially flat member which limits the travel and rotation of the actuating rod housing 98 during storage and is attached to 5 the actuator rod housing 98. This locating key 90 engages slidably in a keyway 89 formed by a slot in the launch mechanism housing 96 as shown in FIG. 8.

An arming pin 82 is provided extending substantially vertically through the actuating rod housing 98. This arming pin 82 passes through the actuating rod detent assembly 84 preventing it from rotating when the emergency location marking system 11 is in a collapsed stowed condition and the lock pin 80 has been disengaged. A transit locking pin 118 passing through the shank of the arming pin 82 near its free end must be removed from the arming pin 82 before it can be withdrawn so that the actuating rod can rotate.

One mechanism by which the telescoping antenna and support tower 20*a* and 20*f* is raised is purely mechanical involving the antenna mast extension springs 52*a*–52*e*. In the collapsed storage position the antenna mast extension springs 52*a*–52*e* are held compressed by the tension on the electrical and retraction cable 46 which is wound around the spool 44 mounted substantially horizontally rotatably in the spool chamber 22 immediately below the water-tight plate 21. In this collapsed storage position the spool 44 is prevented from rotating by a ratchet pawl 38 engaged in a ratchet gear 42 rigidly attached to one end of the spool 44. The ratchet pawl 38 is rigidly connected to a rotational actuating bar 58 of the actuating rod detent assembly and push plate 84. When the actuating rod detent assembly and push plate 84 are released by disengaging the lock pin 80 however and the arming pin 82 the rotational actuating bar 58 is free to rotate under a torque provided to the rotational actuating bar by an actuator spring 36 and the pawl 38 is disengaged from the ratchet gear 42 releasing the spool 44 so that the antenna mast extension springs 52*a*–52*e* act to raise the antenna tower and support tower 20*a*–20*f*.

More specifically the pawl 38 is attached by a pawl extension 10 nonrotatably to an extension of the rotational actuating bar 58 mounted rotatably in a bearing and gas seal 72 in a substantially vertical wall in the water-tight space between the upper water-tight platform 21 and the lower water-tight plate 27. This vertical wall divides the water-tight space into a gas plenum 68 containing the spool chamber 22 and spool 44 beneath the antenna and support tower and a water-tight buoyancy compartment 79 containing a valve chamber 24 and the actuating rod detent assembly 84 with the rotational actuating bar 58 beneath the gas cylinders 28. This extension of the rotational actuating bar 58 is connected to a torsion spring 62 coaxial with it and on the other end the rotational actuating bar 58 then passes through an internal gasket 86 in the outer casing 12 and continues to pass through an external gasket 88 in the actuating rod housing 98. A circular compression plate 88a is attached to the rotational actuating bat 58 just inside the actuating rod housing 98. Between the internal gasket 86 and the torsion spring 62 two lever rods 78 are rigidly and nonrotatably attached to the rotational actuating bar 58 each of which is approximately beneath one of the gas cylinders 28. An actuator spring rod 57 is rigidly attached to the lever holders 78 near the free ends of the lever holders substantially parallel to the actuating bar 58. An actuator spring 36 is somewhat centrally attached to the actuator spring rod 57 under tension form a spring tensioning control 76 which is a substantially toroidal piece having an adjustment screw 77 for adjusting the tension on the spring. When the actuating bar 58 is released as described above the actuator spring 36 acts to rotate the lever holders 78 and the actuating bar 58 disengaging the pawl 38 from the ratchet 42 so that the spool 44 can rotate and the antenna and support tower **20*a*–20*f* rise under a certain amount of restraint from the electrical and retraction cable 46**.

For mechanical retraction of the antenna and support tower **20*a*–20*f* the spool 44 is rigidly nonrotatably mounted on a rewind shaft 50 which is mounted rotatably in a wall of the spool chamber 22 opposite the wall dividing the gas plenum 68 and the water-tight compartment 79 adjacent the ratchet 42. This rewind shaft 50 extends through a bearing mount 70 in the outer casing 12 and into an exteriorly threaded gas-tight fitting 55 which receives a threaded cap 59 when the antenna and support tower is not being retracted. When retraction is necessary the threaded cap 59 is removed and a removably rewind crank arm 54 is engaged in the end of the rewind shaft 50 through the gas-tight fitting 55. The end of the rewind shaft 50 is conformed to engage the end of the crank arm 54, for example a slot can be provided in the end of the rewind shaft 50 and a protruding plate member on the end of the crank arm 54**.

Figure 5:
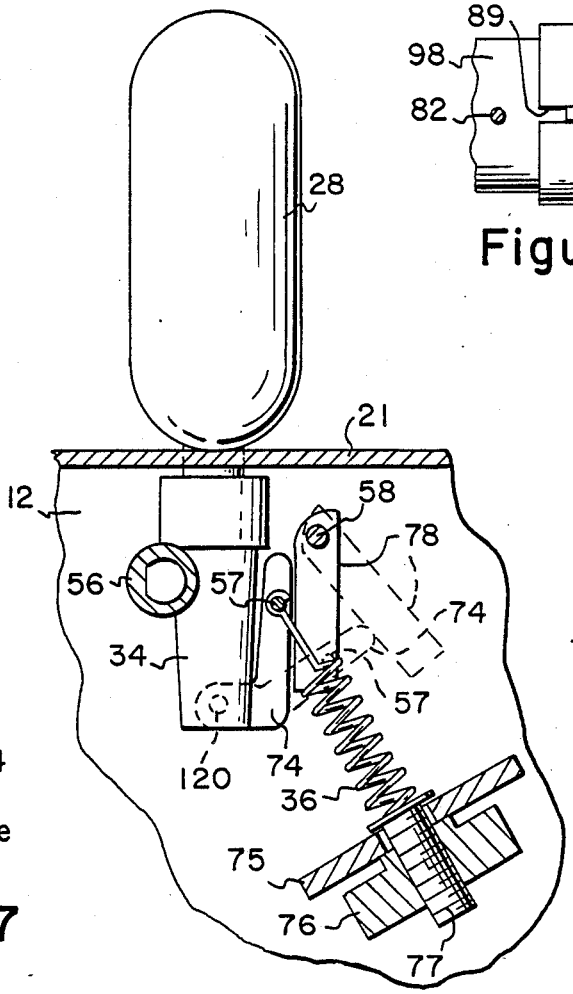
FIG. 5 is a detailed cross sectional view taken along the line 5—5 of FIG. 4 showing the gas valve lever mechanism.

Another mechanism for raising the antenna and support tower **20*a*–20*f* is available. As a backup the tower can be raised pneumatically by compressed gas from the gas cylinders 28. The lever holders 78 before deployment press on the valve levers 74 of the gas valves 34 of the gas cylinders 28 holding the valves 34 closed. When the lever holders 78 which are rotatably mounted on valve lever pivots 120 rotate on actuating and deploying the location marker system 11 the gas valves 34 open. The valve levers 74 as shown in FIG. 5 are rotated by the valve springs 36 attached adjacent their free ends so that the valves 34 are opened releasing gas into the gas manifold 56. The gas manifold 56 is connected to two pressure-actuated lid opening actuators 130 through time delay orifices 136 at both the top cover 14 and the bottom cover 26 by the T-joint gas line 53. The gas manifold 56 is also connected to the gas-tight gas plenum 68 and through that to the space containing the antenna and support tower 20*a*–20*f* which is covered by a gas-tight shroud 18 which expands under the influence of in-rushing gas raising the antenna and support tower 20*a*–20*f***.

Figure 7:
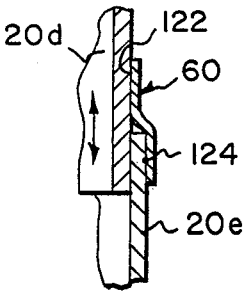
FIG. 7 is an enlarged cross sectional view as indicated by numeral 7 in FIG. 3 of one of the electrical continuity clips.
Figure 6:
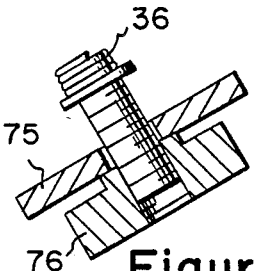
FIG. 6 is a partial detailed cross sectional view similar to FIG. 5, showing the threaded adjustment screw threaded moved upwardly caused the actuator spring to have less tension for resetting.
Figure 9:
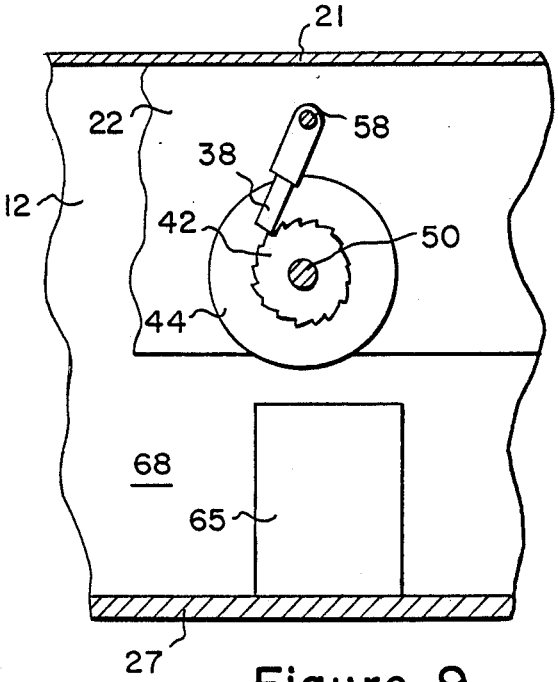
FIG. 9 is a cross sectional view taken along line 9—9 in FIG. 4 showing the ratchet and pawl assembly in greater detail.

The tension on a valve springs 36 and the action of the corresponding gas valves 34 can be adjusted using the valve spring tensioning control 76 which is mounted in an angular plate 75 with the valve spring adjustment screw 77 as shown in FIGS. 6 and 7. The valve spring adjustment screw 77 is exteriorly threaded and engages in the internally threaded toroidal valve spring tensioning control 76.

An antenna support guide 66 assisting in retraction and erection of the antenna and support tower **20*a*–20*f* is provided. This antenna support guide 66 is a cylindrical pipe section and just fits around the bottom segment 20f of the antenna and support tower. It is attached to the water-tight, plate 21**.

LOCATION-INDICATING DEVICES

Several location-indicating devices are provided on this example of the emergency location marker system 11. The top tubular segment of the antenna and support tower **20*a*–20*f* has twin electrically driven audio sounders 128 laterally attached which are especially useful in a foggy environment. These audio sounders 128 can however be turned off to conserve power by one of the control switches 132**.

An emergency position-indicating radio beacon-(EPIRB) 48 is mounted on the inside surface of the outer casing 12 adjacent the antenna and support tower **20*a*–20*f* to provide an RF signal indicating the position of the emergency location marker system 11** to facilitate satellite tracking.

A storage compartment 40 for flares, dyes and other survival-enhancing items including food and water is position opposite the EPIRB attached inside the outer casing 12.

The electrical supply and retraction cable 46 is electrically connected to a battery pack 64 power supply through comutator rings 110 and 112 for the entire location marker system 11 on the water-tight plate 27 inside the gas-tight gas plenum 68. The LF radio signal generated by the LF transmitter and associated antenna **20*a* to 20*f*** can be detected by a DF or ADF available to a rescue party or in the case of a VHF transmitter by a directional VHF antenna and receiver available to the rescue party.

The passive reflector for radar and light and strobe light

Figure 12:
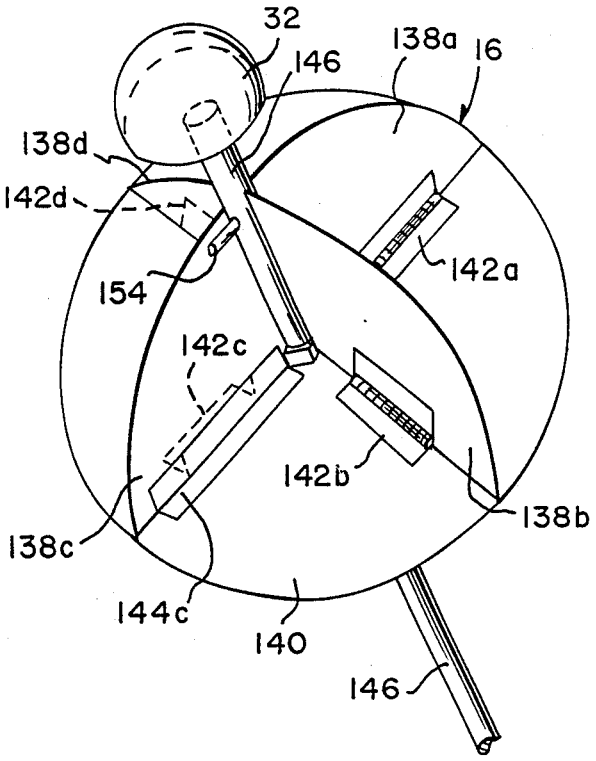
FIG. 12 is a perspective view of the passive reflector in its self-erected position.
Figure 13:
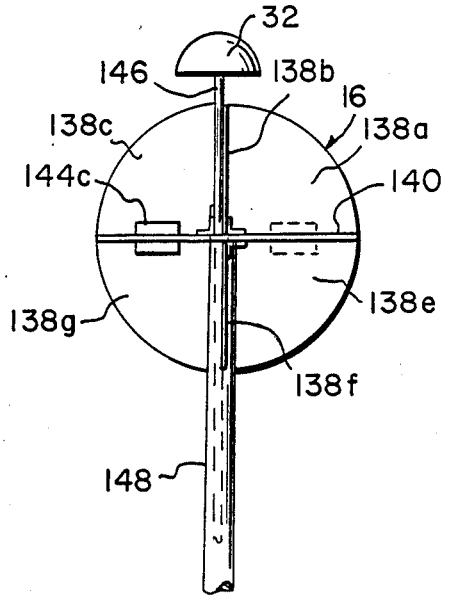
FIG. 13 is a side elevational view of the passive reflector in its self-erected position.
Figure 14:
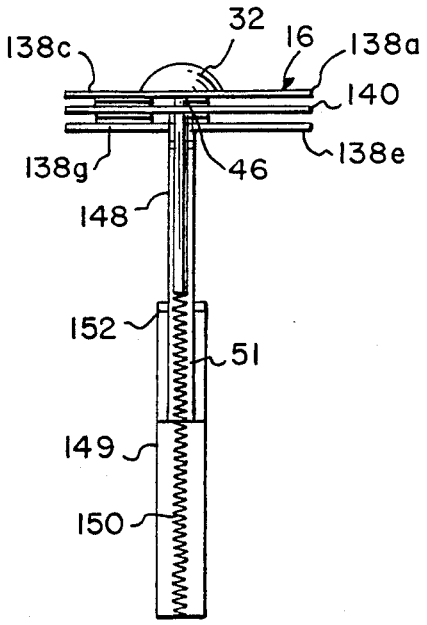
FIG. 14 is a side elevational view of the passive reflector in its collapsed configuration.

A strobe light 32 and a collapsible self-erecting passive reflector 16 for radar and light are attached to the uppermost segment **20*a* of the telescoping antenna and support tower 20*a*–20*f* as shown in detail in FIGS. 12 to 14. Both the strobe light 32 and the passive reflector 16 spring up with the location marker system is deployed. The collapsed configuration is shown in FIG. 14 while the deployed unfolded configuration s shown in FIG. 13**.

The reflector 16 is supported at the peak of the tower by a lower pop-up reflector tube 149 near the uppermost segment **20*a* of the antenna and support tower 20*a*–20*f*. The eight reflective foldable vertical quadrants 138*a*–138*h* and the one horizontal element 140 are mounted at the upper end of an upper pop-up reflector tube 148 mounted in the lower pip-up reflector tube 149 of larger diameter. The upper pop-up reflector tube 148 extends through the collar 152 of the lower pop-up reflector tube 149**.

The strobe light 32 is attached to the upper end of a pop-up strobe shaft 146 which has laterally extending vertical limit bracket 154. The outer diameter of this pop-up strobe shaft 146 is smaller than the inner diameter of the upper pop-up reflector tube 148 in which it is slidably mounted and the pop-up strobe shaft 146 is acted on by a strobe pop up spring 151 attached to the pop-up strobe shaft 146 which raises the strobe light 32 further when the emergency location marker system 11 is deployed. This is necessary to accommodate the unfolded reflector. The passive reflector 16 may also function to reflect and enhance light from the strobe light as well as radar.

The passive reflector 16 provides a plurality of reflective surfaces for both radar and light substantially at right angles to each other when deployed and unfolded. A horizontal element 150 which comprises a substantially circular plate is attached substantially perpendicular to the upper end portion of the upper pop-up reflector tube 148. Four quadrants 138*a*–138*d* are hingedly attached to the top surface of the horizontal element 140 by spring-loaded hinges 142*a*–142*d*. The reflector pop up spring 151 is compressed in the stowed configuration and the spring-loaded quadrants 138*a*–138*d* are folded down. However, when the spool 44 is released and the tension taken off the cable 46 and the strobe light 32 pops up and the quadrants 138*a*–138*d* unfold because of the spring-loaded hinges 142*a*–142*d* but their unfolding motion is limited by the vertical limit bracket 154 and the horizontal limit brackets 144*a*–144*d* which are attached to the horizontal element 140 on the opposite sides of the individual quadrants 138*a*–138*d* from the spring-loaded hinges. Then these quadrants deploy are right angles to each other when the passive reflector 16 unfolds. Four other quadrants 138*e*–138*h* are hingedly attached below the horizontal element 140 by the spring-loaded hinges 142*e*–142*f* and similarly unfold at right angles limited by the horizontal limit brackets 144*e*–144*h*.

ELECTRICAL SUPPLY AND CONTROL SYSTEM

The power supply for the electrical devices is a DC battery pack 64. In this example rechargable NICAD batteries are used so that the power supply can be recharged. A twelve volt DC plus voltage is supplied by the center conductor in the rotational actuating bar 58 and assembly 84 supplied at location 108. A 12 V DC common is supplied through attachment tube 98 and the outer casing 12. The 12 V DC supply is current limited to limit recharge current to a maximum of 1 Ma. The supply voltage is reverse current protected at the power pack within the ELMS. This is achieved by blocking diodes in both the plus and minus lines. This prevents the power pack from discharging back through the supply.

The voltage supplied by the battery pack 64 is first switched on by the master on/off switches 134. These supply the LF transmitter 65, the strobe light 32 and the audio sounders 128 through the individual control switches 132 contained in the top of the outer casing 12 which allow the power to the audio sounders 128 and the strobe light 32 to be selectively switched on and off to conserve power during daylight or when there is no fog. A test switch is also provided for testing the audio sounders 128, the strobe light 32 and the LF transmitter 65 prior to deployment. The EPIRB can also have a separate on/off switch.

Figure 10:
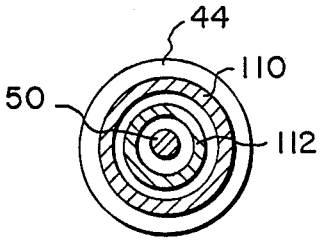
FIG. 10 is a cross sectional view taken along line 10—10 in FIG. 4 showing the comutator assemblies in greater detail.

As seen in FIG. 10 a circular commutator contact 110 for positive voltage and a smaller circular concentric commutator contact 112 for negative voltage are provided on the spool 44. Also the cable 46 provides an electrical path to the strobe light 32 and the audio sounders 182. To facilitate conduction between the segments 20*a* to 20*e* of the antenna and support tower as shown in FIG. 7 an electrical continuity clip 60 made of a conductive material comprising a sliding electric contact 122 and a permanent electric contact 124 attached to the upper edge of a segment 20*a* to 20*e* is provided. This ensures correct antenna function.

MECHANICAL OPERATION

Deployment

To arm the unit the arming pin 82 and the transit lock pin 118 are removed. When the D-ring 102 is pulled the shaft 114 provides a lateral force on the cam 104 which rotates in a counterclockwise direction about the cam assembly axle 105. This displaces the vertical cam follower 106 upward and the lock pin 80 is disengaged from the actuating rod detent assembly and push plate 84. Ejector compression spring 92 which has been held in compression is now free to expand exerting a lateral force against the actuating rod push plat, actuating rod housing 98 and locating key 90. Once free of the launch mechanism housing 96 and ejectro spring 92 the actuating shaft of actuating rod detent assembly 84 and actuating bar 58 are free to rotate. The rotational effort now exerted on lever holders 78 by the actuator spring 36 through actuator spring rod 57 now causes actuating bat 58 to rotate. This rotational force is imparted through the pawl extension 100 to ratchet pawl 38 releasing the constraint on spool 44. Spool 44 is now free to rotate and does so as the result of tension on cable 46. This tension is derived from the forces imparted by the antenna mast extension springs 52*a* to 52*e*. When lever holders 78 were freed to rotate as described, valve levers 74 no longer restrained move downward by the force exerted by actuator spring 36, the gas release valves 34 now open allowing the gas contained in the gas cylinders 28 to enter gas manifold 56 and to 'T' junction gas line 53 which supplies gas under pressure to lid actuators 130 via time delay orifices 136. The gas manifold 56 is vented to the gas-tight plenum 68 and from the gas plenum 68 to the antennas support guide 66 into the space enclosed by the shroud 18 which surrounds the antenna and support tower 20. After a time delay determined by setting the time delay orifices 136 the lid opening actuators 130 impart sufficient force to the top cover 14 and the bottom cover 26 so that they open. Then the antenna and support tower 20 extends together with the shroud 18 which assists the extension since it is being filled with gas from the gas plenum 68 as described. The drogue 25 now sinks under its own weight and deploys. It remains attached to the ELMS unit by the conductive cable 25*a* which provides 'grounding' for the antenna counterpoise plate 27*a*. The master switch 134 is switched on by rotation of the shaft 58. This facilitates application of a DC voltage to the LF transmitter 65, the strobe unit 32 and the audio sounders 128. The DC to the strobe unit and audio sounders 128 is supplied via control switches 132 allowing them to be turned on and off as required. The system is now fully deployed. For remote deployment the lock pin release solenoid 107 is energized from any one of number of remote release buttons. All subsequent functions are the same.

Recovery and Return

At the completion of the recovery procedures the deployed unit must be recovered and returned to the vessel 10. Once on board gas cap 59 is removed allowing gas plenum gas to escape through gas fitting 55. Crank handle 54 is inserted into the rewind shaft 50.

Spring tension control 76 is rotated counterclockwise to remove tension from actuator spring 36. The actuating rod detent assembly 84 is rotated counterclockwise bringing lever holders 78 into the vertical position and thus closing gas release valves 34 with levers 74. Arming pin 82 and transit locking pin 118 are inserted. With the release valve 34 closed and the lever holders 78 locked in place by virtue of arming pin 82 rotational actuating bar 58 engages ratchet pawl 38 with ratchet gear 42. Torsion spring 62 now acts to hold the pawl 38 engaged in ratchet 42. Rewind crank handle 54 is now rotated clockwise which draws retraction cable 46 onto the spool 44 causing the antenna and support tower 20 to retract and the shroud 18 to collapse forcing any gas that remains to exit via gas fitting 55. The shroud 18 in its collapsed state is stowed around the antenna support guide 66. Gas cylinders 28 can now be removed and new cylinders fitted. The crank handle 54 is stowed. Gas cap 59 is refitted to gas fitting 55 and tightened to insure that gas cannot escape. The spring tensioning control 76 is now turned fully clockwise bringing actuator spring 36 to is designed level of tension. Water-tight plate 27 is refitted and the drogue 25 and the conductive cable **25*a* refitted. At the top of the unit the collapsible self-erecting passive reflector 16 is collapsed, the strobe unit is depressed and the top cover 14 is refitted. The drogue 25 is put in the bottom of the unit and the bottom cover 26 is refitted. The unit is now inserted into the launch mechanism 96. The ejector spring 92 is compressed. D-ring 102 is pulled to raise lock pin 80 and when keyway 90 is fully aligned D-ring 102 is released lock pin 80 is pushed down by the lock pin compression spring 94 resetting itself in the actuating rod detent assembly 84 preventing any lateral or rotational movement. The launch mechanism housing 96 is attached to the stern of the vessel 10 in bracket 13. Transit locking pin 118 and arming pin 82 are now removed after insuring that lock pin 80 is fully seated as evidenced by the D-ring 102 being fully forward adjacent to the launch mechanism housing 96 and that keyway 89 and locating key 90** are correctly positioned.

LIST OF REFERENCE NUMBERS

10 stern of vessel
11 emergency location marker system
12 outer casing
13 bracket
14 top cover (spring-loaded and gas-actuated)
15 man in water
16 collapsible self-erecting passive reflector
18 shroud
**20*a*–20*f*** telescoping antenna and support tower (segments a to f)
21 water-tight plate
22 spool chamber
24 valve chamber
25 drogue (sea anchor and LF grounding system)
**25*a*** conductive cable
26 bottom cover (spring-loaded and gas-actuated)
**26*a*** auxiliary buoyancy bag
27 water-tight plate
**27*a*** copper plate forming counterpoise
28 gas cylinders
32 strobe light
34 gas valve
36 actuator spring
38 ratchet pawl
40 general storage (flares etc.)
42 ratchet gear
44 spool
46 electrical and retraction cable (power cable for strobes)
48 emergency position indicating radio beacon-(EPIRB)
50 rewind shaft
**52*a*–52*e*** antenna mast extension springs
53 T-joint gas line to lid actuators
54 removable rewind crank handle
55 gas-tight fitting
56 gas manifold
57 gas valve lever actuating rod
58 rotational actuating bar
59 cap
60 electrical continuity clip
62 torsion spring
64 battery pack
65 low frequency transmitter
66 antenna support guide
68 gas plenum
70 bearing mount
72 bearing and gas seal
74 valve levers
75 angular plate
76 valve spring tensioning control
77 valve spring adjustment screw
78 lever holders
79 water-tight buoyancy compartment
80 lock pin
82 arming pin
84 actuating rod detent assembly and push plate
86 internal gasket
88 external gasket
**88*a*** compression plate
89 keyway
90 locating key(limits travel and rotation of actuating rod housing)
92 ejector compression spring
94 lock pin compression spring
96 launch mechanism housing
98 actuating rod housing
100 pawl extension
102 D-ring
104 lock pin actuator cam
105 cam assembly axle
106 cam follower
107 lock pin solenoid(remote release)
108 12 VDC+trickle charge supply (12 VCD via ejectro compression spring)
109 electromechanical release module
110 commutator contact+
112 commutator contact−
114 D-ring release shaft
116 attachment ring
118 transmit locking pin
120 valve lever pivot
122 sliding electric contact
124 permanent electric contact
128 audio sounders
130 lid opening actuator
132 control switches
134 master on/off switches
136 time delay orifice
**138*a*–138*h*** quadrants (eight in total vertical section)
140 horizontal element
**142*a*–142*h*** spring-loaded hinges
**144*a*** to horizontal limit brackets 144*h*
146 pop-up strobe shaft
148 upper pop-up reflector tube
149 lower pop-up reflector tube
150 reflector pop up spring
151 strobe pop up spring
152 collar
154 vertical limit bracket It will be understood that each of the elements described above, or two or more together, may also find a useful application in other devices differing from the type of device described above.

The invention is not intended to be limited to the details provided above and it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed is new and what is desired to be protected by Letters Patent is set forth in the following claims:

1. An emergency location marker system stored on a vessel for locating and assisting an individual in the water comprising a flotation and support structure with an antenna and support tower, a plurality of location-indicating devices including a passive reflector for radar and light, an audio sounder and a strobe light at least one of which is mounted in the top portion of said antenna and support tower and a low frequency radio transmitter mounted in said flotation and support structure having an electrical and retraction cable connected to the top portion of said antenna and support tower, a mechanical deploying and actuating assembly for launching said emergency location marker system and for actuating said tower and said location-indicating devices and an electrical supply and control system for said location-indicating devices including a rechargable battery pack and control switches for individually activating and deactivating said location-indicating devices.

2. An emergency location marker system stowed on a vessel for marking and signaling from a location on the water, especially for locating and rescuing an individual in said water, comprising: a floatation and support structure with a collapsible self-erecting tower; at least one location-indicating device at least one of which is mounted on said collapsible self-erecting tower, said at least one location indicating device including an audio sounder mounted in the top portion of said collapsible self-erecting tower; a mechanical deploying and actuating assembly for launching said emergency location marker system, for actuating said collapsible self-erecting tower, and said location-indicating device; and an electrical supply and control system for said location-indicating at least one device.

3. An emergency location marker system according to claim 2 in which said at least one locating-indicating device includes a strobe light mounted in the top portion of said collapsible self-erecting tower.

4. An emergency location marker system according to claim 2 in which said at least one location-indicating device includes a low frequency transmitter and an electrical and retracting cable connected to the top portion of said collapsible self-erecting tower connected electrically to a battery pack and a strobe light and an audio sounder.

5. An emergency location marker system according to claim 2 in which said at least one location-indicating device includes a collapsible self-erecting passive reflector for light and radar mounted in the top portion of said collapsible self-erecting tower below a strobe light.

6. An emergency location marker system according to claim 5 wherein said collapsible self-erecting passive reflector for light and radar has a plurality of reflective surfaces for both radar and light waves substantially at right angles to each other when unfolded and comprises a horizontal element which is a substantially circular plate attached substantially perpendicularly to the upper end portion of an upper spring-loaded pop-up reflector tube in said top portion, two groups of four reflective quadrants hingedly attached to said horizontal element above and below said horizontal element which fold flat against said horizontal element before deployment but spring open when said collapsible self-erecting tower is deployed to take positions substantially at right angles to each other abutting against a plurality of horizontal limit brackets attached to said horizontal element.

7. An emergency location marker system according to claim 2 in which said floatation and support structure comprises a rigid pipe-like outer casing, a spring-loaded gas-actuated top cover, a spring-loaded gas-actuated bottom cover, and upper water-tight plate on which a telescoping antenna and support tower comprising said collapsible self-erecting tower is mounted extending interiorly across said outer casing and a water-tight plate mounted extending transversely across the interior of said outer casing below said upper water-tight plate, said bottom cover and said top cover being hingedly connected to said rigid outer casing, said upper water-tight plate and said lower water-tight plate defining a space containing a gas plenum communicating with a plurality of gas cylinders on said water-tight plate through gas valves and with a space above said water-tight plate inside a shroud attached to said water-tight plate enclosing a portion of said collapsible self-erecting tower and also enclosing a water-tight compartment containing a portion of said mechanical deploying and actuating assembly.

8. An emergency location maker system according to claim 7 in which said mechanical deploying and actuating assembly comprises an electromechanical release module which remains mounted on said vessel on which said emergency location marker system is stowed before launch, a plurality of mechanical antenna-actuating springs mounted inside said telescoping antenna and support tower acting to extend said telescoping antenna and support tower, a gas-tight shroud attached to said upper water-tight plate and to said top portion of said telescoping antenna and support tower, an electrical and retraction cable attached in the vicinity of said top portion of said telescoping antenna and support tower to said tower which is wound around a spool mounted in a spool chamber in said gas plenum, said spool having a detachable crank handle engagable with said spool from the exterior of said outer casing for winding said cable on said spool to collapse and stow said telescoping antenna and support tower and a gas delivery and valve device including gas cylinders with mechanically controlled gas valves for delivery of gas to said gas plenum.

9. An emergency location marker system according to claim 7 having a deployable drogue electrically connected by a conductive cable to said water-tight plate immediately above said bottom cover and a counterpoise plate made of copper attached to and coextensive with said water-tight plate.

10. An emergency location marker system according to claim 8 in which said mechanical deploying and actuating assembly has two lever rods rigidly and non-rotatably attached to a rotational actuating bar of said actuating rod detent assembly and push plate, each of which is approximately located beneath one of said gas cylinders, an actuator spring rod rigidly attached between said level holders near the free ends of said lever holders substantially parallel to said rotational actuating bar and an adjustable actuator spring somewhat centrally attached to said actuator spring rod providing a torque on said rotational actuating bar and said lever holders, each of said lever holders before deployment pressing on a valve levers of said gas valves for said gas cylinders holding said gas valves closed but when said lever holders which are engaged with said valve levers pivot when said rotational actuator bar is released said gas valves open releasing gas into a gas manifold connected to two pressure-actuated lid opening actuators through time delay orifices one at said top cover and the other at said bottom cover to open said top cover and said bottom cover and to said gas plenum, said gas plenum being connected to said shroud so said gas inflates said shroud and acts to raise said telescoping antenna and support tower.

11. An emergency location marker system according to claim 8 in which said electromechanical release module comprises a launch mechanism housing mounted on said vessel, a lock pin engaged in an actuating rod detent assembly and push plate mounted in the pipe-like actuating rod housing substantially in said outer casing, an ejector compression spring located in said launch mechanism housing engaged on said push plate mounted in said actuating rod housing and a lock pin-cam assembly for releasing said lock pin from said actuating rod detent assembly and push plate so that said ejector compression spring acts to force said push plate and said actuating rod housing with said entire emergency location marker system from said electromagnetic release module and said vessel.

12. An emergency location marking system according to claim 8 in which in the collapsed stowed configuration with said antenna and support tower collapsed said spool is prevented from rotating by a ratchet pawl engaged in a ratchet gear rigidly attached to one end of said spool, said ratchet pawl being rigidly connected to a rotational actuating bar of said actuating rod detent assembly and push plate and when said lock pin and an arming pin engaged with said actuating rod detent assembly and push plate are both disengaged said rotational actuating bar is free to rotate and said pawl is disengaged from said ratchet gear by action of an adjustable actuating spring providing a torque to said rotational actuating bar so that said antenna mast extension springs act to raise said antenna tower and support tower.

* * * * *